US006223724B1

(12) United States Patent
Miyaji et al.

(10) Patent No.: US 6,223,724 B1
(45) Date of Patent: May 1, 2001

(54) HIGH-PRESSURE FUEL PUMP

(75) Inventors: Wakaki Miyaji; Yoshihiko Onishi; Katsunori Tanaka; Kouichi Ojima, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/481,413

(22) Filed: Jan. 12, 2000

(30) Foreign Application Priority Data

Aug. 20, 1999 (JP) ..... 11-234326

(51) Int. Cl.[7] ..... F02M 37/04
(52) U.S. Cl. ..... 123/446; 417/540
(58) Field of Search ..... 123/495, 446–7; 417/571, 269, 222.1, 540–2

(56) References Cited

U.S. PATENT DOCUMENTS 6,053,712 * 4/2000 Konishi et al. ..... 123/446
6,131,549 * 10/2000 Onishi ..... 123/495

FOREIGN PATENT DOCUMENTS 10-122128 5/1998 (JP) ..... F04B/1/22
10-131860 5/1998 (JP) ..... F04B/43/08
197 46 907 5/1998 (DE) .
11-44267 2/1999 (JP) ..... F02M/37/00

* cited by examiner

*Primary Examiner*—Thomas N. Moulis
(74) *Attorney, Agent, or Firm*—Sughrue, Mion, Zinn, Macpeak & Seas, PLLC

(57) ABSTRACT

A first fuel inlet, a second fuel inlet, a first fuel outlet, and a second fuel outlet of a valve assembly of a high-pressure fuel pump are formed radially outside an aperture portion of a fuel pressurization chamber.

5 Claims, 12 Drawing Sheets

HIGH-PRESSURE FUEL PUMP

BACKGROUND OF THE INVENTION

1. Field of the Invention

The present invention relates to a high-pressure fuel pump installed in a high-pressure fuel supply assembly used in a cylinder-injected engine, for example.

2. Description of the Related Art

FIG. 10 is a block diagram of a conventional high-pressure fuel supply assembly 100, and FIG. 11 is a cross section thereof. This high-pressure fuel supply assembly 100 includes:

a low-pressure damper 2 for absorbing surges in low-pressure fuel, the low-pressure damper 2 being connected to a low-pressure fuel intake passage 1 through which flows low-pressure fuel from a low-pressure fuel pump (not shown);

a high-pressure fuel pump 3 for pressurizing low-pressure fuel from the low-pressure damper 2;

a high-pressure damper 5 for absorbing surges in the high-pressure fuel flowing through a high-pressure fuel discharge passage 4 connected to the high-pressure fuel pump 3; and a check valve for improving the starting of an engine by maintaining fuel in a delivery pipe 8 at high pressure even when the engine is stopped, the check valve being disposed between the high-pressure damper 5 and a fuel supply port 7 and opening when the fuel pressure on the delivery pipe 8 side is lower than the fuel pressure on the high-pressure damper 5 side. Moreover, in the drawings, 17 is a passage connecting to a high-pressure regulator (not shown) from between the fuel supply port 7 and the delivery pipe 8.

The above low-pressure damper 2 is mounted in a first recess 10*a* in a casing 10. The low-pressure damper 2 includes: a cylindrical holder 14; a base 13 having a ball 11 disposed in a bore 12; and a metal bellows 15 disposed inside the holder 14.

The above high-pressure fuel pump 3 includes: a valve assembly 20 for opening and closing the low-pressure fuel intake passage 1 and the high-pressure fuel discharge passage 4; and a high-pressure fuel supply body 21 for pressurizing low-pressure fuel and discharging it into the high-pressure fuel discharge passage 4.

FIG. 12 is a partial enlargement of FIG. 11, FIG. 13 is a view of the valve assembly 20 in FIG. 11 seen from the low-pressure fuel intake passage 1 and high-pressure fuel discharge passage 4 side, FIG. 14 is a view of the valve assembly 20 in FIG. 11 seen from the high-pressure fuel supply body 21 side, and FIG. 15 is a cross section taken along line XV—XV in FIG. 13.

The valve assembly 20 includes a first plate 22, a second plate 23, and a thin, flat valve main body 19 positioned between the first and second plates 22 and 23. First fuel inlets 24 connected to the low-pressure fuel intake passage 1 and a first fuel outlet 25 connected to the high-pressure fuel discharge passage 4 are formed in the first plate 22, the inside dimensions of the first fuel outlet 25 being larger than the inside dimensions of the first fuel inlets 24. A second fuel inlet 26 having inside dimensions larger than those of the first fuel inlets 24 and a second fuel outlet 27 having inside dimensions smaller than those of the first fuel outlet 25 are formed in the second plate 23. As shown in FIG. 16, the valve main body 19 is provided with intake-side tongues 28 interposed between the first fuel inlets 24 and the second fuel inlet 26, and a discharge-side tongue 29 interposed between the first fuel outlet 25 and the second fuel outlet 27.

The high-pressure fuel supply body 21 includes: a casing 10 housing the valve assembly 20 inside a second recess 10*b*; a cylindrical sleeve 30 housed in surface contact with the second plate 23 inside the second recess 10*b*; a piston 33 slidably inserted inside the sleeve 30 to form a fuel pressurization chamber 32 in cooperation with the sleeve 30, the piston 33 pressurizing fuel flowing into the fuel pressurization chamber 32 through an aperture portion 200; and a first spring 36 disposed between a recessed bottom surface 34 of the piston 33 and a holder 35, the spring 36 applying force to the piston 33 in a direction which expands the volume of the fuel pressurization chamber 32.

The high-pressure fuel supply body 21 also includes: a housing 37 fitted over the sleeve 30; a ring-shaped securing member 38 securing the valve assembly 20, the sleeve 30, and the housing 37 inside the second recess 10*b* of the casing 10 by fitting over the housing 37 and engaging the second recess 10*b* of the casing 10 by a male thread portion formed on an outer circumferential surface of the securing member 38; a metal bellows 40 disposed between the housing 37 and a receiving portion 39; a second spring 41 compressed and disposed around the outside of the bellows 40 between the housing 37 and a holder 42; and a bracket 43 disposed to surround the second spring 41, the bracket 43 being secured to the casing 10 by a bolt (not shown). Moreover, 150 is a drainage duct passing through the sleeve 30, the valve assembly 20, and the casing 10 for expelling to the fuel tank (not shown) fuel which has leaked out from between the sleeve 30 and the piston 33.

The high-pressure fuel supply body 21 also includes: a tappet 44 slidably disposed in a slide bore 43*a* in an end portion of the bracket 43; a pin 45 rotatably suspended in the tappet 44; a bush 46 rotatably disposed on the pin 45; and a cam roller 47 rotatably disposed on the bush 46, the cam roller 47 contacting a cam (not shown) secured to a cam shaft (not shown), following the shape thereof, and reciprocating the piston 33.

In a high-pressure fuel supply assembly 100 having the above construction, the piston 33 is reciprocated by the rotation of the cam secured to the cam shaft of an engine (not shown) by means of the cam roller 47, the bush 46, the pin 45, and the tappet 44.

When the piston 33 is descending (during the fuel intake stroke), the volume of the inside of the fuel pressurization chamber 32 increases and the pressure inside the fuel pressurization chamber 32 decreases. When the pressure inside the fuel pressurization chamber 32 falls below the pressure at the first fuel inlets 24, the intake-side tongues 28 of the valve main body 19 bend towards the second fuel inlet 26, allowing fuel in the low-pressure fuel supply passage 1 to flow through the first fuel inlets 24 into the fuel pressurization chamber 32.

When the piston 33 is ascending (during the fuel discharge stroke), the pressure inside the fuel pressurization chamber 32 increases, and when the pressure inside the fuel pressurization chamber 32 rises above the pressure at the first fuel outlet 25, the discharge-side tongue 29 of the valve main body 19 bends towards the first fuel outlet 25, allowing fuel in the fuel pressurization chamber 32 to flow through the first fuel outlet 25 and the fuel discharge passage 4 into the high-pressure damper 5, where fuel pressure surges are absorbed. High-pressure fuel is then supplied to the delivery pipe 8 via the check valve 6 and the fuel supply port 7, and thereafter supplied to the fuel injection valves 9, which inject fuel into each of the cylinders (not shown) of the engine.

In the high-pressure fuel pump 3 of the high-pressure fuel supply assembly 100 of the above construction, the housing 37, the sleeve 30, and the valve assembly 20 are held inside the second recess 10b by the securing member 38. As shown in FIG. 11, the bearing pressure to which the valve assembly 20 is subjected is extremely low at the aperture portion 200 of the pressurization chamber 32 and increases radially outwards from the aperture portion 200.

At the central portion of the valve assembly 20, the pressure bearing on the valve assembly 20 is extremely low, and during the fuel intake stroke, when the load acting on a peripheral portion 27*a* of the second fuel outlet 27 on the second plate 23 through the discharge-side tongue 29 at the mouth of the first fuel outlet 25 corresponds to the cross-sectional area of the mouth multiplied by the discharge pressure, there is a risk that the second plate 23 will be deformed by the load towards the piston 33 in the vicinity of the central portion where the pressure bearing on the peripheral portion 27*a* is extremely low.

Similarly, during the fuel discharge stroke, when the load acting on peripheral portions 24a of the first fuel inlets 24 on the first plate 22 through the intake-side tongues 28 at the mouth of the second fuel inlet 26 due to the high pressure in the fuel pressurization chamber 32 corresponds to the cross-sectional area of the mouth multiplied by the pressure inside the fuel pressurization chamber, there is a risk that the first plate 22 will be deformed by the load towards the high-pressure damper 5 in the vicinity of the central portion where the pressure bearing on the peripheral portion 24*a* is extremely low.

When the second plate 23 or the first plate 22 bend in this manner, even though there should not normally be any gap between the second plate 23 and the discharge-side tongue 29 during the fuel intake stroke, a gap forms between the second plate 23 and the discharge-side tongue 29 in the vicinity of the central portion where the bearing pressure is drops extremely. Similarly, even though there should not normally be any gaps between the first plate 22 and the intake-side tongues 28 during the fuel discharge stroke, gaps form between the first plate 22 and the intake-side tongues 28 in the vicinity of the central portion where the bearing pressure is extremely low. Consequently, when the discharge pressure is high, one problem has been that fuel leaks out from between the second plate 23 and the discharge-side tongue 29 during the fuel intake stroke, and out from between the first plate 22 and the intake-side tongues 28 during the fuel discharge stroke, dramatically reducing volumetric efficiency {(the actual amount of fuel discharged into the high-pressure fuel discharge passage 4 from the fuel pressurization chamber 32 during one stroke of the piston 33)/(the cross-sectional area of the piston 33 X the stroke distance)}. Another problem has been that due to the formation of the above gaps, fretting occurs in places other than the intake-side tongues 28 and the discharge-side tongue 29 of the valve main body 19, such as between elements of the casing 10, the valve assembly 20, and the sleeve 30, giving rise to fuel leaks from gaps there and reducing the discharge flow.

SUMMARY OF THE INVENTION

The present invention aims to solve the above problems and an object of the present invention is to provide a high-pressure fuel pump with improved volumetric efficiency in which valve fretting is prevented.

To this end, according to the present invention, there is provided that a high-pressure fuel pump comprising: a valve assembly disposed between a low-pressure fuel intake passage and a high-pressure fuel discharge passage, the valve assembly opening and closing the low-pressure fuel intake passage and the high-pressure fuel discharge passage; and a high-pressure fuel supply body for pressurizing low-pressure fuel flowing in from the low-pressure fuel intake passage and discharging the pressurized fuel into the high-pressure fuel discharge passage, the valve assembly including: a first plate having a first fuel inlet connected to the low-pressure fuel intake passage, and a first fuel outlet connected to the high-pressure fuel discharge passage; a second plate having a second fuel inlet having inside dimensions larger than inside dimensions of the first fuel inlet and a second fuel outlet having inside dimensions smaller than inside dimensions of the first fuel outlet; and a thin, flat valve main body positioned between the first plate and the second plate, the valve main body having an intake-side tongue interposed between the first fuel inlet and the second fuel inlet opening only when fuel flows from the low-pressure fuel intake passage into the high-pressure fuel supply body, and a discharge-side tongue interposed between the first fuel outlet and the second fuel outlet opening only when fuel flows from the high-pressure fuel supply body into the high-pressure fuel discharge passage, the high-pressure fuel supply body including: a casing housing the valve assembly in a recess; a sleeve housed in the recess in surface contact with the valve assembly; a piston slidably inserted into the sleeve forming a fuel pressurization chamber in cooperation with the sleeve, the piston pressurizing fuel flowing into the fuel pressurization chamber through an aperture portion; and a securing member securing the sleeve inside the recess by pressing an outer circumferential portion of the sleeve towards the valve assembly, the first fuel inlet, the second fuel inlet, the first fuel outlet, and the second fuel outlet of the valve assembly being formed radially outside the aperture portion.

DETAILED DESCRIPTION OF THE PREFERRED EMBODIMENTS

A high-pressure fuel pump according to the present invention installed in a high-pressure fuel supply assembly will be explained below. Parts the same as or corresponding to those in FIGS. 10 to 16 above will be given the same numbering.

Embodiment 1

Figure 1:
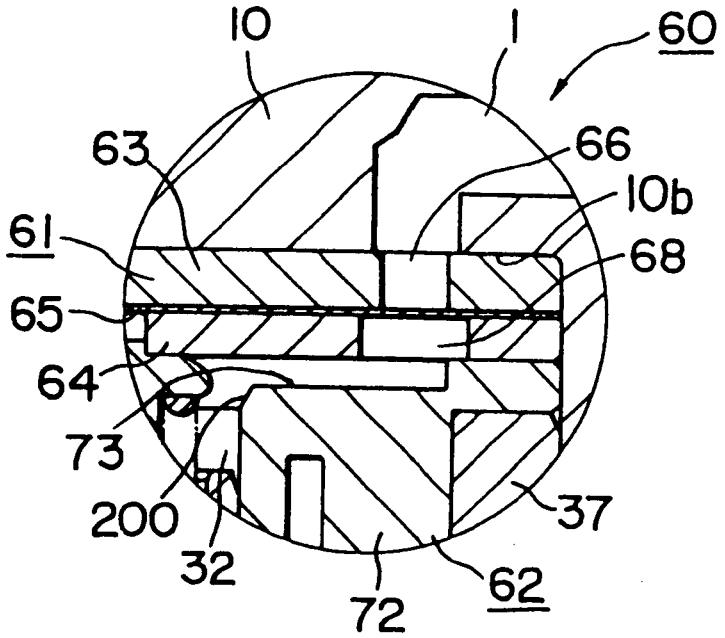
FIG. 1 is a partial cross section of a high-pressure fuel pump according to Embodiment 1 of the present invention.

FIG. 1 is a partial cross section of a high-pressure fuel pump 60 according to Embodiment 1 of the present invention. The high-pressure fuel pump includes: a valve assembly 61 for opening and closing a low-pressure fuel intake passage 1 and a high-pressure fuel discharge passage 4; and a high-pressure fuel supply body 61 for pressurizing low-pressure fuel and discharging the pressurized fuel into the high-pressure fuel discharge passage 4.

Figure 2:
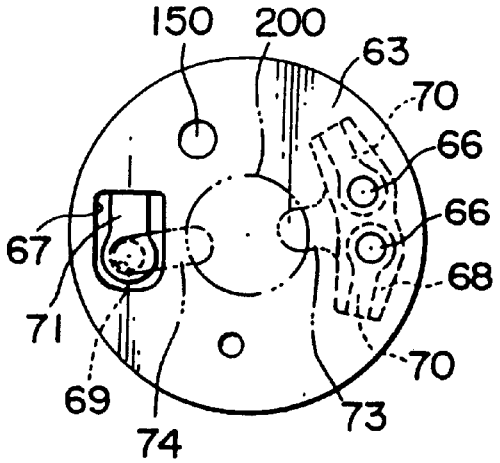
FIG. 2 is a view of the valve assembly in FIG. 1 seen from the low-pressure fuel intake passage and high-pressure fuel discharge passage side.
Figure 3:
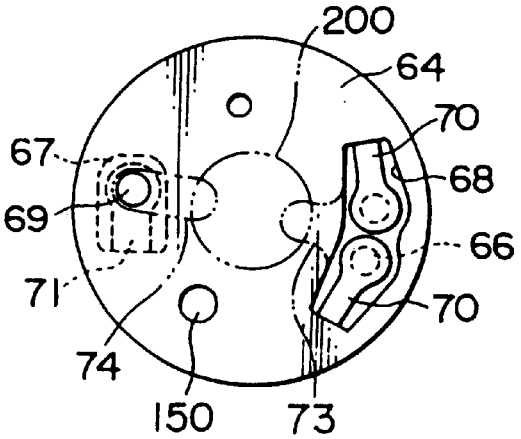
FIG. 3 is a view of the valve assembly in FIG. 1 seen from the high-pressure fuel supply body side.
Figure 4:
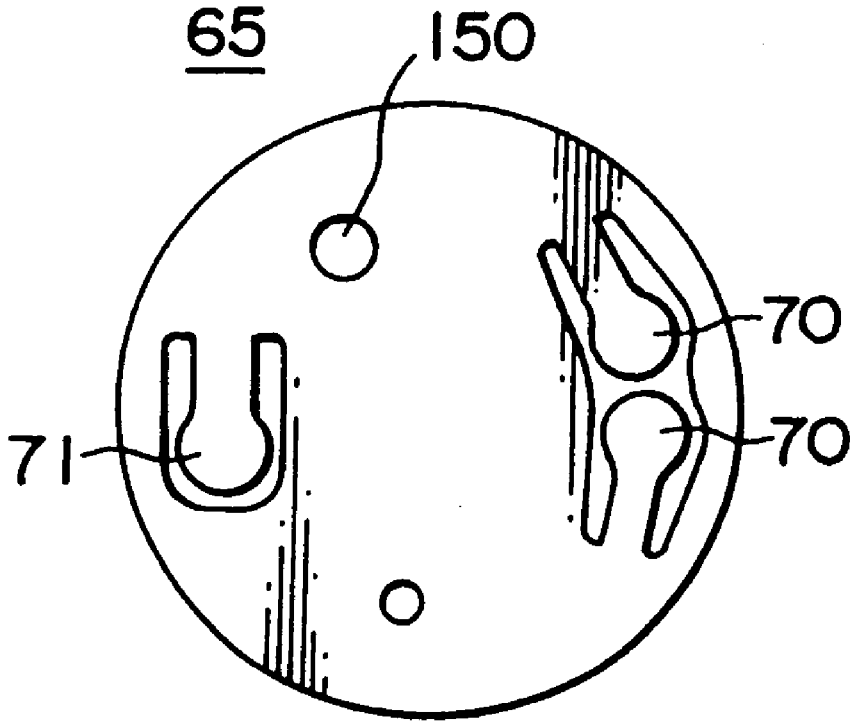
FIG. 4 is a front elevation of the valve main body in FIG. 1.

FIG. 2 is a view of the valve assembly 61 in FIG. 1 seen from the low-pressure fuel intake passage 1 and high-pressure fuel discharge passage 4 side, FIG. 3 is a view of the valve assembly 61 in FIG. 1 seen from the high-pressure fuel supply body 62 side, and FIG. 4 is a front elevation of a valve main body 65.

The valve assembly 61 includes a first plate 63, a second plate 64, and a thin, flat valve main body 65 positioned between the first and second plates 63 and 64.

First fuel inlets 66 connected to the low-pressure fuel intake passage 1 and a first fuel outlet 67 connected to the high-pressure fuel discharge passage 4 are formed in the first plate 63, the inside dimensions of the first fuel outlet 67 being larger than the inside dimensions of the first fuel inlets 66. A second fuel inlet 68 having inside dimensions larger than those of the first fuel inlets 66 and a second fuel outlet 69 having inside dimensions smaller than those of the first fuel outlet 67 are formed in the second plate 64. The valve main body 65 is provided with intake-side tongues 70 interposed between the first fuel inlets 66 and the second fuel inlet 68, and a discharge-side tongue 71 interposed between the first fuel outlet 67 and the second fuel outlet 69.

The first fuel inlets 66 and the second fuel inlet 68, which are connected to the low-pressure fuel intake passage 1, are disposed so as to be positioned radially outside and away from an aperture portion 200 of the fuel pressurization chamber 32. The first fuel outlets 67 and the second fuel outlet 69, which are connected to the high-pressure fuel intake passage 4, are also disposed so as to be positioned radially outside and away from the aperture portion 200.

The high-pressure fuel supply body 62 includes: a casing 10 housing the valve assembly 61 inside a second recess 10*b*; a cylindrical sleeve 72 housed in surface contact with the second plate 64 inside the second recess 10*b*; a piston 33 slidably inserted inside the sleeve 72 to form a fuel pressurization chamber 32 in cooperation with the sleeve 72, the piston 33 pressurizing fuel flowing into the fuel pressurization chamber 32 through the aperture portion 200; and a first spring 36 disposed between a recessed bottom surface 34 of the piston 33 and a holder 35, the spring 36 applying force to the piston 33 in a direction which expands the volume of the fuel pressurization chamber 32. A first connecting groove 73 for guiding fuel from the first fuel inlets 66 and the second fuel inlet 68 to the aperture portion 200 of the fuel pressurization chamber 32 is formed in the sleeve 72. A second connecting groove 74 for guiding fuel from the aperture portion 200 of the fuel pressurization chamber 32 to the first fuel outlet 67 and the second fuel outlet 69 is also formed in the sleeve 72.

The high-pressure fuel supply body 62 also includes: a housing 37 fitted over the sleeve 72; a ring-shaped securing member 38 securing the valve assembly 61, the sleeve 72, and the housing 37 inside the second recess 10*b* of the casing 10 by fitting over the housing 37 and engaging the second recess 10*b* of the casing 10 by a male thread portion formed on an outer circumferential surface of the securing member 38; a metal bellows 40 disposed between the housing 37 and a receiving portion 39; a second spring 41 compressed and disposed around the outside of the bellows 40 between the housing 37 and a holder 42; and a bracket 43 disposed to surround the second spring 41, the bracket 43 being secured to the casing 10 by a bolt (not shown).

The high-pressure fuel supply body 62 also includes: a tappet 44 slidably disposed in a slide bore 43*a* in an end portion of the bracket 43; a pin 45 rotatably suspended in the tappet 44; a bush 46 rotatably disposed on the pin 45; and a cam roller 47 rotatably disposed on the bush 46, the cam roller 47 contacting a cam (not shown) secured to a cam shaft (not shown) and reciprocating the piston 33.

In a high-pressure fuel pump 60 having the above construction, the piston 33 is reciprocated by the rotation of the cam secured to the cam shaft of an engine (not shown) by means of the cam roller 47, the pin 45, and the tappet 44.

When the piston 33 is descending (during the fuel intake stroke), the volume of the inside of the fuel pressurization chamber 32 increases and the pressure inside the fuel pressurization chamber 32 decreases. When the pressure inside the fuel pressurization chamber 32 falls below the pressure at the first fuel inlets 66, the intake-side tongues 70 of the valve main body 65 bend towards the second fuel inlet 68, allowing fuel in the low-pressure fuel supply passage 1 to flow through the first fuel inlets 66 into the fuel pressurization chamber 32.

When the piston 33 is ascending (during the fuel discharge stroke), the pressure inside the fuel pressurization chamber 32 increases, and when the pressure inside the fuel pressurization chamber 32 rises above the pressure at the first fuel outlet 67, the discharge-side tongue 71 of the valve main body 65 bends towards the first fuel outlet 67, allowing fuel in the fuel pressurization chamber 32 to flow through the first fuel outlet 67 and the fuel discharge passage 4 into the high-pressure damper 5, where fuel pressure surges are absorbed. High-pressure fuel is then supplied to the delivery pipe 8 via the check valve 6 and the fuel supply port 7, and thereafter supplied to the fuel injection valves 9, which inject fuel into each of the cylinders (not shown) of the engine.

In a high-pressure fuel pump 60 of the above construction, the housing 37, the sleeve 72, and the valve assembly 61 are held inside the second recess 10*b* of the casing 10 by the securing member 38, subjecting an outer circumferential portion of the valve assembly to a high bearing pressure. The first fuel inlets 66 and the second fuel inlet 68 are disposed in this circumferential portion of the valve assembly 61, as are the first fuel outlet 67 and the second fuel outlet 69.

Thus, because the vicinity of the first fuel inlets 66, the second fuel inlet 68, the first fuel outlet 67, and the second fuel outlet 69 are held with firm strength between the casing 10 and the sleeve 72, the formation of undesirable gaps between the second plate 64 and the discharge-side tongue 71 is suppressed during the fuel intake stroke, and similarly, the formation of undesirable gaps between the first plate 63 and the intake-side tongues 70 is suppressed during the fuel discharge stroke. Consequently, the volumetric efficiency will not drop suddenly due to the formation of gaps in the valve assembly 61 even if the fuel discharge pressure rises.

Figure 5:
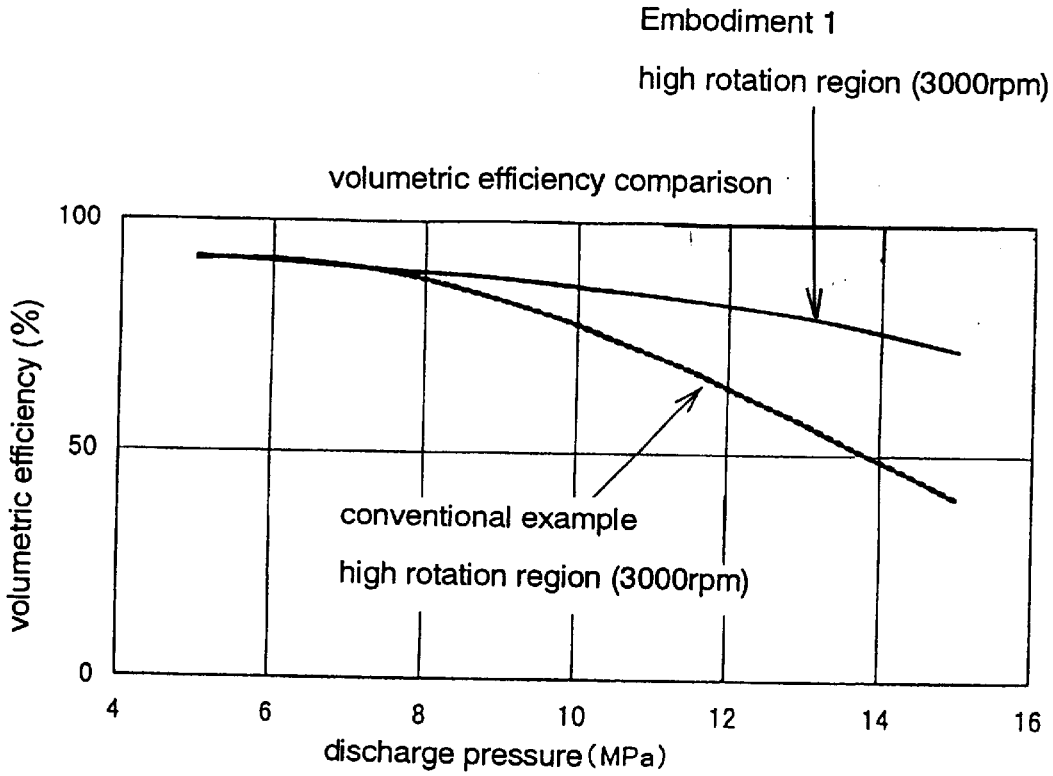
FIG. 5 is a graph of the relationship between fuel discharge pressure and volumetric efficiency in a high-pressure fuel pump.

FIG. 5 is a graph showing the relationship between the discharge pressure of the fuel from the fuel pressurization chamber 32 and volumetric efficiency and is based on data obtained in experiments conducted by the present inventors comparing a comparative example with Embodiment 1 of the present invention under conditions where an engine was running at 3000 rpm. From these results, it can be seen that whereas in the comparative example the volumetric efficiency drops suddenly due to the formation of gaps when the discharge pressure of the fuel exceeds 8 MPa, the drop in volumetric efficiency was significantly improved in Embodiment 1 of the present invention even when the discharge pressure of the fuel rose higher still.

Figure 6:
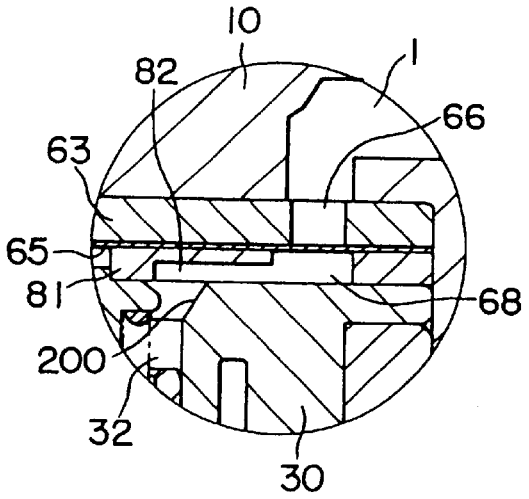
FIG. 6 is a partial cross section showing a variation of the high-pressure fuel pump according to Embodiment 1 of the present invention.

Moreover, as shown in FIG. 6, a first connecting groove 82 for guiding fuel from the first fuel inlets 66 and the second fuel inlet 68 to the aperture portion 200 of the fuel pressurization chamber 32 may also be formed in a second plate 81. Similarly, a second connecting groove for guiding fuel from the aperture portion 200 of the fuel pressurization chamber 32 to the first fuel outlet 67 and the second fuel outlet 69 may also be formed in the second plate 81.

Figure 7:
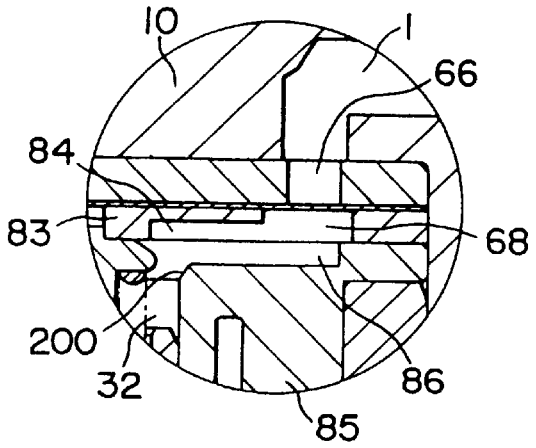
FIG. 7 is a partial cross section showing another variation of the high-pressure fuel pump according to Embodiment 1 of the present invention.

Furthermore, as shown in FIG. 7, a first connecting groove 84 for guiding fuel from the first fuel inlets 66 and the second fuel inlet 68 to the aperture portion 200 of the fuel pressurization chamber 32 may also be formed in a second plate 83. A first connecting groove 86 may also be formed facing the first connecting groove 84 in a sleeve 85. Similarly, a second connecting groove for guiding fuel from the aperture portion 200 of the fuel pressurization chamber 32 to the first fuel outlet 67 and the second fuel outlet 69 may also be formed in the second plate 83, and a second connecting groove may also be also formed in the sleeve 85 facing the second connecting groove.

Embodiment 2

Figure 8:
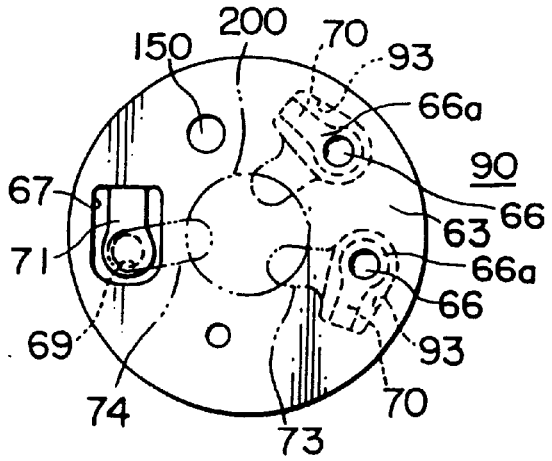
FIG. 8 is a view of a valve assembly in a high-pressure fuel pump according to Embodiment 2 of the present invention seen from the low-pressure fuel intake passage and high-pressure fuel discharge passage side.
Figure 9:
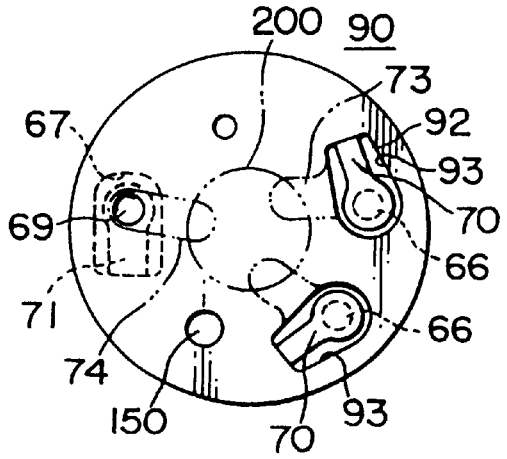
FIG. 9 is a view of the valve assembly in FIG. 8 seen from the high-pressure fuel supply body side.
Figure 10:
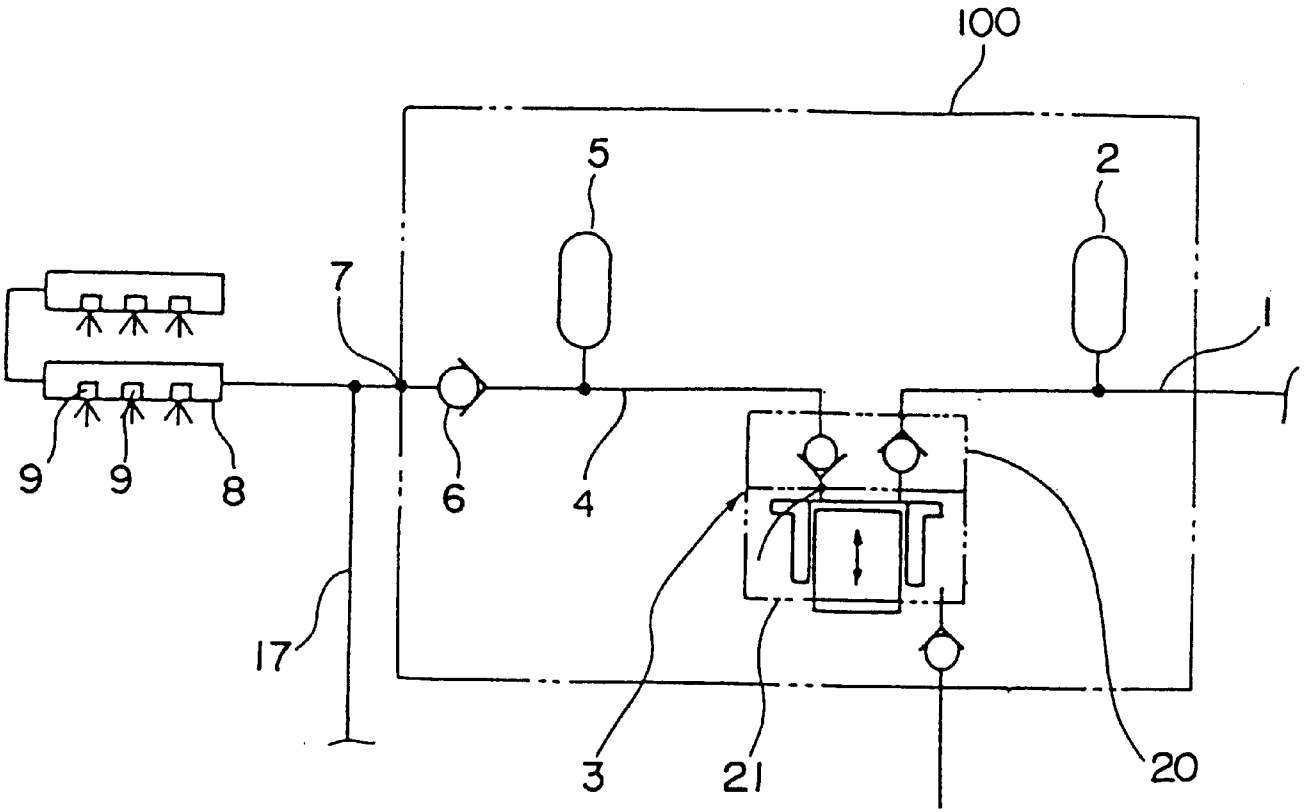
FIG. 10 is a block diagram showing a construction of a conventional high-pressure fuel supply assembly.
Figure 11:
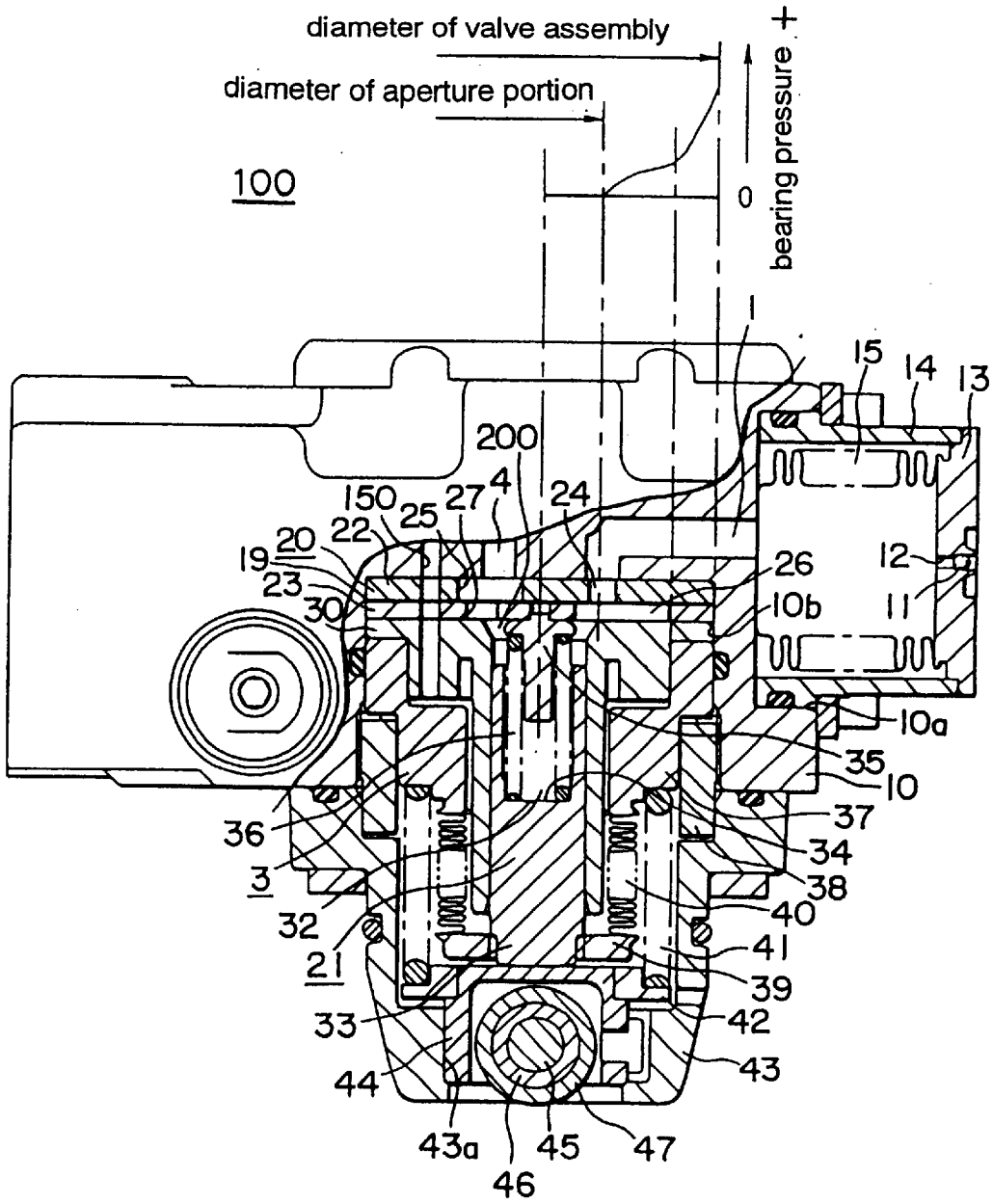
FIG. 11 is a cross section of a conventional high-pressure fuel supply assembly.
Figure 12:
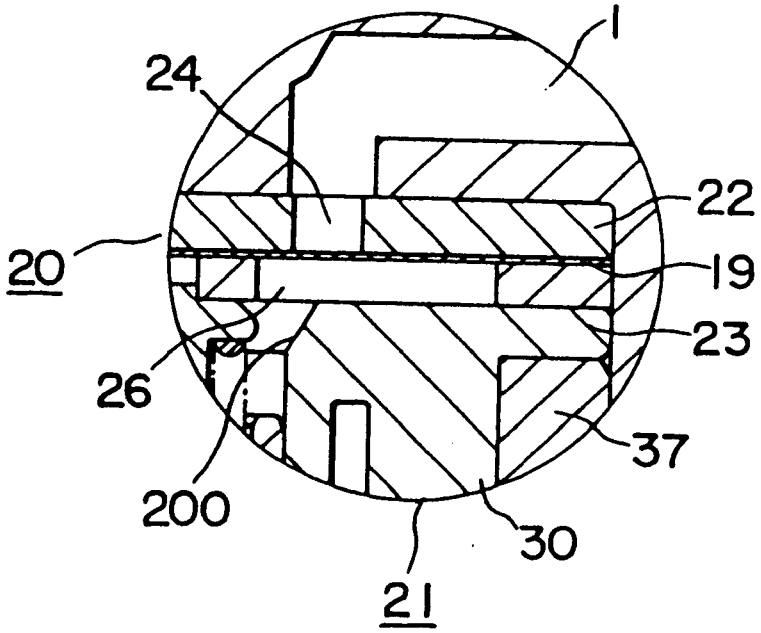
FIG. 12 is a partial enlargement of FIG. 11.
Figure 13:
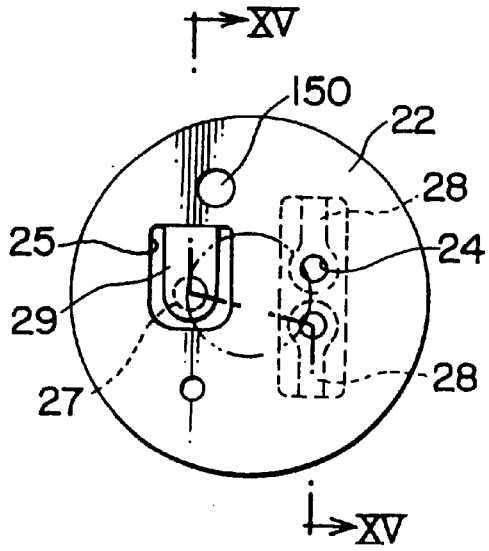
FIG. 13 is a view of the valve assembly in FIG. 11 seen from the low-pressure fuel intake passage and high-pressure fuel discharge passage side.
Figure 14:
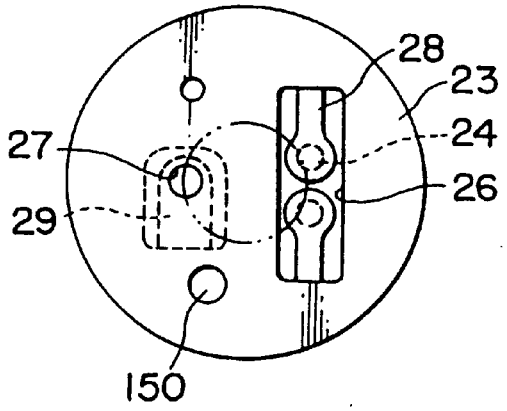
FIG. 14 is a view of the valve assembly in FIG. 11 seen from the high-pressure fuel supply body side.
Figure 15:
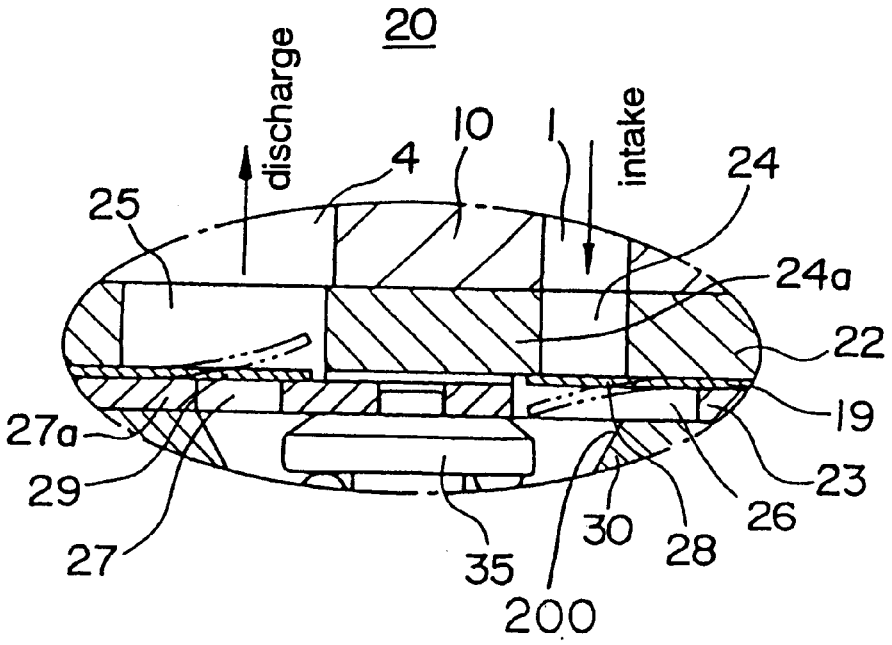
FIG. 15 is a cross section taken along line XV—XV in FIG. 13.
Figure 16:
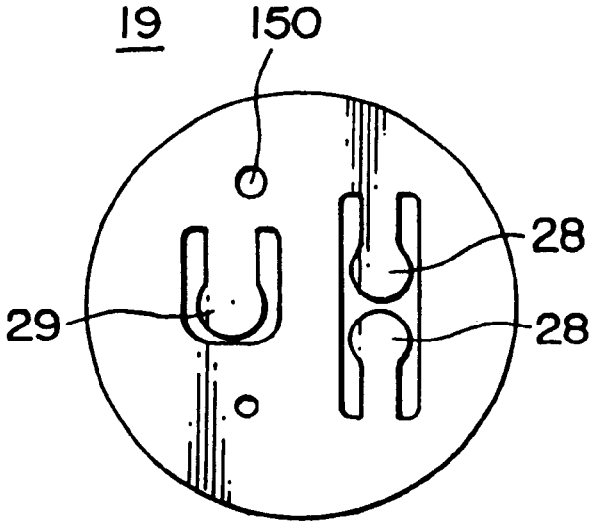
FIG. 16 is a front elevation of the valve main body in FIG. 11.

FIG. 8 is a view of a valve assembly 90 in a high-pressure fuel pump 60 according to Embodiment 2 of the present invention seen from the low-pressure fuel intake passage 1 and high-pressure fuel discharge passage 4 side, and FIG. 9 is a view of the valve assembly 90 in FIG. 8 seen from the high-pressure fuel supply body 62 side.

In Embodiment 1, the second fuel inlet 68 was disposed in one place on the second plate 64, but in Embodiment 2, second fuel inlets 93 are formed separately in two places on a second plate 92 and are positioned radially outside and away from the aperture portion 200 of the fuel pressurization chamber 32.

The rest of the construction is the same as for Embodiment 1 and explanation thereof will be omitted.

In the fuel discharge stroke, the load of the high-pressure fuel pressurized in the fuel pressurization chamber 32 acts on peripheral portions 66*a* of the first fuel inlets 66 in the first plate 63 through the intake-side tongues 70, and that load is proportional to the cross-sectional area of the opening of the second fuel inlets 93 in the second plate 92. Whereas in Embodiment 1 the second fuel inlet 68 was disposed in one place and a large load proportionate to the cross-sectional area of the opening thereof acted on the peripheral portions 66*a* of the first fuel inlets 66 in the first plate 63, in Embodiment 2 the second fuel inlets 93 are positioned in two separate places and the load acting on the peripheral portions 66*a* of the first fuel inlets 66 in the first plate 63 is dispersed proportionately, enabling local deformation of the first plate 63 to be suppressed proportionately.

Moreover, fuel inlets can also be disposed in three or more places on the second plate. Furthermore, by disposing a number of separate first outlets on the first plate, local deformation of the fuel outlets on the second plate can also be suppressed.

As explained above, a high-pressure fuel pump according to one aspect of the present invention comprises the valve assembly that the first fuel inlet, the second fuel inlet, the first fuel outlet, and the second fuel outlet are formed radially outside the aperture portion. Therefore, a higher bearing pressure is applied to the vicinity of the first fuel inlet, the second fuel inlet, the first fuel outlet, and the second fuel outlet by the casing and the sleeve, so that the formation of gaps between the second plate and the discharge-side tongue is suppressed during the fuel intake stroke, and similarly, the formation of gaps between the first plate and the intake-side tongue is suppressed during the fuel discharge stroke. Consequently, the volumetric efficiency can be prevented from dropping suddenly even if the fuel discharge pressure is raised. Furthermore, the occurrence of fretting in the valve assembly due to the formation of gaps is also prevented.

According to one form of the high-pressure fuel pump, a number of the second fuel inlets may be disposed separately. Therefore, the fuel discharge load to which the first plate is subjected during the fuel discharge stroke is distributed proportionately to the peripheral portions, further suppressing local deformation of the first plate.

According to another form of the high-pressure fuel pump, the sleeve may be formed with: a first connecting groove connecting the second fuel inlet to the aperture portion; and a second connecting groove connecting the aperture portion of the fuel pressurization chamber to the second fuel outlet. Therefore, the fuel inlets can be connected to the fuel pressurization chamber and the fuel pressurization chamber can be connected to the fuel outlets by a simple construction.

According to still another form of the high-pressure fuel pump, the second plate may be formed with: a first connecting groove connecting the second fuel inlet to the aperture portion; and a second connecting groove connecting the aperture portion to the second fuel outlet. Therefore, the fuel inlets can be connected to the fuel pressurization chamber and the fuel pressurization chamber can be connected to the fuel outlets by a simple construction.

According to another form of the high-pressure fuel pump, the sleeve and the second plate may be both formed with: a first connecting groove connecting the second fuel inlet to the aperture portion; and a second connecting groove connecting the aperture portion to the second fuel outlet. Therefore, the fuel inlets can be connected to the fuel pressurization chamber and the fuel pressurization chamber can be connected to the fuel outlets by a simple construction.

What is claimed is:

1. A high-pressure fuel pump comprising:

a valve assembly disposed between a low-pressure fuel intake passage and a high-pressure fuel discharge passage, said valve assembly opening and closing said low-pressure fuel intake passage and said high-pressure fuel discharge passage; and a high-pressure fuel supply body for pressurizing low-pressure fuel flowing in from said low-pressure fuel intake passage and discharging said pressurized fuel into said high-pressure fuel discharge passage, said valve assembly including:

a first plate having a first fuel inlet connected to said low-pressure fuel intake passage, and a first fuel outlet connected to said high-pressure fuel discharge passage;

a second plate having a second fuel inlet having inside dimensions larger than inside dimensions of said first fuel inlet and a second fuel outlet having inside dimensions smaller than inside dimensions of said first fuel outlet; and a thin, flat valve main body positioned between said first plate and said second plate, said valve main body having an intake-side tongue interposed between said first fuel inlet and said second fuel inlet opening only when fuel flows from said low-pressure fuel intake passage into said high-pressure fuel supply body, and a discharge-side tongue interposed between said first fuel outlet and said second fuel outlet opening only when fuel flows from said high-pressure fuel supply body into said high-pressure fuel discharge passage, said high-pressure fuel supply body including:

a casing housing said valve assembly in a recess;

a sleeve housed in said recess in surface contact with said valve assembly;

a piston slidably inserted into said sleeve forming a fuel pressurization chamber in cooperation with said sleeve, said piston pressurizing fuel flowing into said fuel pressurization chamber through an aperture portion; and a securing member securing said sleeve inside said recess by pressing an outer circumferential portion of said sleeve towards said valve assembly, said first fuel inlet, said second fuel inlet, said first fuel outlet, and said second fuel outlet of said valve assembly being formed radially outside said aperture portion.

2. The high-pressure fuel pump according to claim 1 wherein a number of said second fuel inlets are disposed separately.

3. The high-pressure fuel pump according to claim 1 wherein said sleeve is formed with:

a first connecting groove connecting said second fuel inlet to said aperture portion;

and a second connecting groove connecting said aperture portion of said fuel pressurization chamber to said second fuel outlet.

4. The high-pressure fuel pump according to claim 1 wherein said second plate is formed with:

a first connecting groove connecting said second fuel inlet to said aperture portion;

and a second connecting groove connecting said aperture portion to said second fuel outlet.

5. The high-pressure fuel pump according to claim 1 wherein said sleeve and said second plate are both formed with:

a first connecting groove connecting said second fuel inlet to said aperture portion;

and a second connecting groove connecting said aperture portion to said second fuel outlet.

* * * * *